US011463812B1

(12) United States Patent
Yang

(10) Patent No.: US 11,463,812 B1
(45) Date of Patent: Oct. 4, 2022

(54) STEREO MICROPHONE SPEAKER

(71) Applicant: Shenzhen Huasirui Technology Co., Ltd., Shenzhen (CN)

(72) Inventor: Bing Yang, Shenzhen (CN)

(73) Assignee: Shenzhen Huasirui Technology Co., Ltd., Shenzhen (CN)

( * ) Notice: Subject to any disclaimer, the term of this patent is extended or adjusted under 35 U.S.C. 154(b) by 0 days.

(21) Appl. No.: 17/396,746

(22) Filed: Aug. 8, 2021

(51) Int. Cl.

| | |
|---|---|
| ***H04R 5/02*** | (2006.01) |
| ***H04R 1/02*** | (2006.01) |
| ***H04R 5/027*** | (2006.01) |
| ***H04R 3/02*** | (2006.01) |

(52) U.S. Cl.
CPC ..... *H04R 5/02* (2013.01); *H04R 1/02* (2013.01); *H04R 3/02* (2013.01); *H04R 5/027* (2013.01)

(58) Field of Classification Search
CPC ... H04R 5/02; H04R 1/02; H04R 3/02; H04R 5/027
See application file for complete search history.

(56) References Cited

U.S. PATENT DOCUMENTS

| | | | | |
|---|---|---|---|---|
| 5,349,480 A * | 9/1994 | Takao | ..... | G11B 31/00 360/137 |
| 10,911,082 B2 * | 2/2021 | You | ..... | G10H 1/361 |
| 11,082,764 B1 * | 8/2021 | Chen | ..... | H04R 1/403 |

* cited by examiner

*Primary Examiner* — Andrew L Sniezek
(74) *Attorney, Agent, or Firm* — Jeenam Park

(57) ABSTRACT

A stereo microphone speaker includes a Printed circuit board, a middle housing, and a handle body. An audio frequency dividing module and an audio playback module are arranged at end surfaces of the Printed circuit board. The handle body includes a handle rear cover and a handle front cover, and an interior of the handle front cover is fixedly connected with a tweeter mounting cavity. An interior of the tweeter mounting cavity is provided with a tweeter. An interior of the handle rear cover defines a subwoofer mounting cavity. An interior of the subwoofer mounting cavity defines a subwoofer, and an upper end of the middle housing defines a silicone microphone installation fixing groove. A silicone microphone support is provided inside the silicone microphone installation fixing groove, and an interior of an upper end of the silicone microphone support is provided with a microphone.

7 Claims, 6 Drawing Sheets

STEREO MICROPHONE SPEAKER

TECHNICAL FIELD

This disclosure relates to the technical field of the microphone speaker, and more particularly relates to a stereo microphone speaker.

BACKGROUND

A Voice tube, also called a microphone, is a kind of electroacoustic equipment, which falls in the category of sound transmission devices. It is a transducer for sonic-electric transformation, by sound waves applied to electroacoustic components to generate voltage, which is then converted into electrical energy. It has been used in various amplification systems. Microphones come in great diversity and simple circuits. Microphones are usually classified according to the way they transfer energy. Here we still use the most common classification method of microphones in recording studios, to divide microphones into dynamic microphones and condenser microphones, and to analyze microphone circuits two points are mainly mastered: (1) The signal transmission circuit analysis, comparatively simple, to analyze input socket circuits of various microphones. (2) The microphone signal amplifier analysis, and the microphone amplifier is a small signal low noise audio amplifier, not difficult to analyze the microphone level control circuit.

With economic development, people are changing their consumption concepts and pursuit ideas, singing and listening to songs become necessary in life, and people who are nervous and tired at work, can sing songs to relax and decompress after work, which is very necessary, but current microphone speakers, comprise common appearance design, poor sound quality as well, no stereo perception, and no distinction between high notes and low notes, and if the volume is turned up a little, the microphone and speaker will produce a howling, quite harsh, causing poor user experience, and current microphones comprise complex structures, with high price, so for singing lovers, to invent a portable, affordable, karaoke microphone of good speaker effect is greatly necessary.

By contrast, the stereo microphone speaker in the disclosure, can effectively improve the sound quality, enhance the user experience, and effectively lower the howling, so that when the volume is turned up, the harsh sound can be effectively reduced, avoiding to cause discomfort for experiencers' ears, and with simple structures, comparatively small size, easy to carry, and with low production costs, market sale prices can be effectively decreased, increasing the market competition strength.

SUMMARY DISCLOSURE

(1) Technical Problems to be Solved

Aiming at the inadequacy of the current technology, the disclosure discloses a stereo microphone speaker, to solve problems of microphone speakers, with common appearance design, poor sound quality as well, no stereo perception, and no distinction between high notes and low notes.

(2) Technical Schemes

To realize the above-mentioned purposes, the disclosure will adopt the following technical schemes: a stereo microphone speaker, comprising Printed circuit boards, middle housings and handle bodies, and end surfaces of the Printed circuit boards are provided with audio frequency dividing modules and audio playback modules, the handle bodies comprise handle rear covers and handle front covers, and upper ends of the handle rear covers and handle front covers constitute structures of middle housings, sides of the middle housings relative to handle front covers are provided with tweeter holes, and interiors of the handle front covers relative to interior sides of tweeter holes are fixedly connected with tweeter mounting cavities, interiors of the tweeter mounting cavities are provided with tweeters;

interior sides of the handle rear covers are provided with subwoofer mounting cavities, and interiors of the subwoofer mounting cavities are provided with subwoofers, upper ends of the middle housings are provided with silicone microphone installation fixing grooves, and interiors of the silicone microphone installation fixing grooves are provided with silicone microphone supports, interiors of upper ends of the silicone microphone supports are provided with microphones.

In some embodiments, threads in the lower ends of the handle bodies are connected with bottom covers, and the Printed circuit boards relative to interiors of the handle bodies are arranged at the lower ends of interiors of bottom covers.

In some embodiments, sides of lower ends of the Printed circuit boards are provided with audio plugs and one side relative to the audio plug is provided with a charging plug, and the audio plugs and charging plugs cut through lower ends of bottom covers.

In some embodiments, upper ends of the middle housings relative to exterior sides of silicone microphone supports are provided with upper housings.

In some embodiments, outer surfaces of the middle housings and upper housings are provided with microphone head covers.

In some embodiments, interiors of the middle housings relative to tweeters and subwoofers respectively are provided with voice chambers.

In some embodiments, one side of the handle body is provided with function keys.

(3) Beneficial Effects

The disclosure discloses a stereo microphone speaker. The following beneficial effects are made:

1. The stereo microphone speakers in the disclosure, by provided subwoofers and tweeters, and audio frequency dividing modules arranged on the Printed circuit boards, improve the sound quality with audio playback modules, and enhance the user experience.

2. The stereo microphone speakers in the disclosure, by setting up silicone microphone supports into silicone microphone installation fixing grooves on the middle housings to form the support use for microphones, can effectively lower the howling, so that when the volume is turned up, the harsh sound can be effectively reduced, avoiding to cause discomfort for experiencers.

3. The stereo microphone speakers in the disclosure, can by microphone head covers form the protection use for exterior sides of middle housings and upper housings, thus avoiding to cause breakage and damage when falling to the ground, forming the great protection use.

The stereo microphone speakers in the disclosure, with simple structures, comparatively small size, easy to carry, and with quite good sound quality effect, improved stereo perception of sound quality, and low production costs, can decrease market sale prices effectively, and increase the market competition strength.

Figure 1:
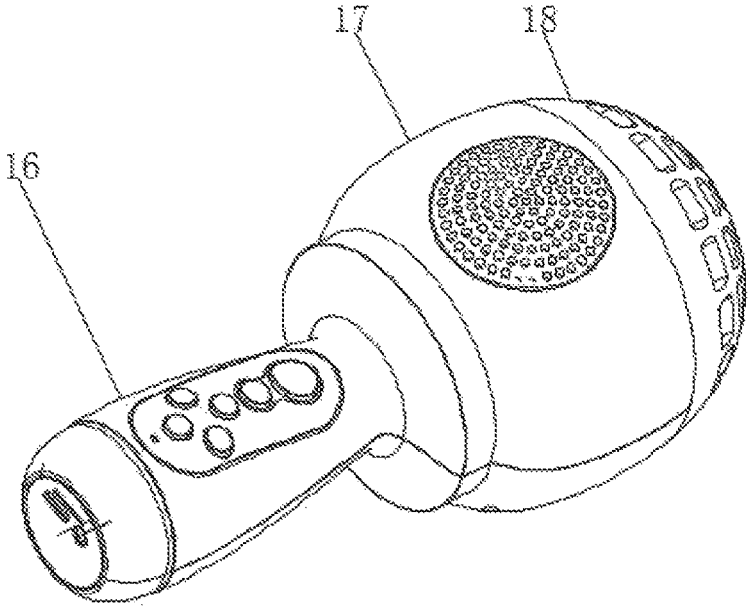
FIG. 1 is a stereoscopic view of a stereo microphone speaker in the disclosure.

In the drawings, 1. Audio plugs: 2. Charging plugs: 3. Audio frequency dividing modules: 4. Audio playback modules: 5. Printed circuit boards: 6. Handle rear covers; 7. Subwoofers: 8. Silicone microphone supports: 9. Tweeters; 10. Handle front covers; 11. Bottom covers; 12. Tweeter mounting cavities; 13. Silicone microphone installation fixing grooves; 14. Subwoofer mounting cavities; 15. Voice chambers; 16. Handle bodies; 17. Middle housings: 18. Upper housings: 19. Function keys: 20 Tweeter holes; 21. Microphone; 22. Microphone head covers.

DETAILED DESCRIPTION OF ILLUSTRATIVE EMBODIMENTS

With the combination of drawings attached in the embodiment of the disclosure, a clear and complete description about technical schemes of the embodiment in the disclosure will be given below, and obviously, described embodiments are a part of those in the disclosure, other than all embodiments. Based on embodiments of the disclosure, all other embodiments acquired by common technicians in the field without the premise of doing the creative work, are within the protection scope of the disclosure.

Embodiments

Figure 2:
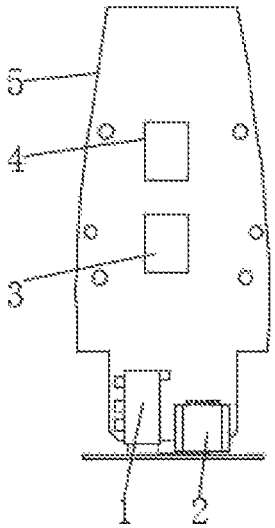
FIG. 2 is a structural schematic diagram of Printed circuit boards of a stereo microphone speaker in the disclosure.
Figure 3:
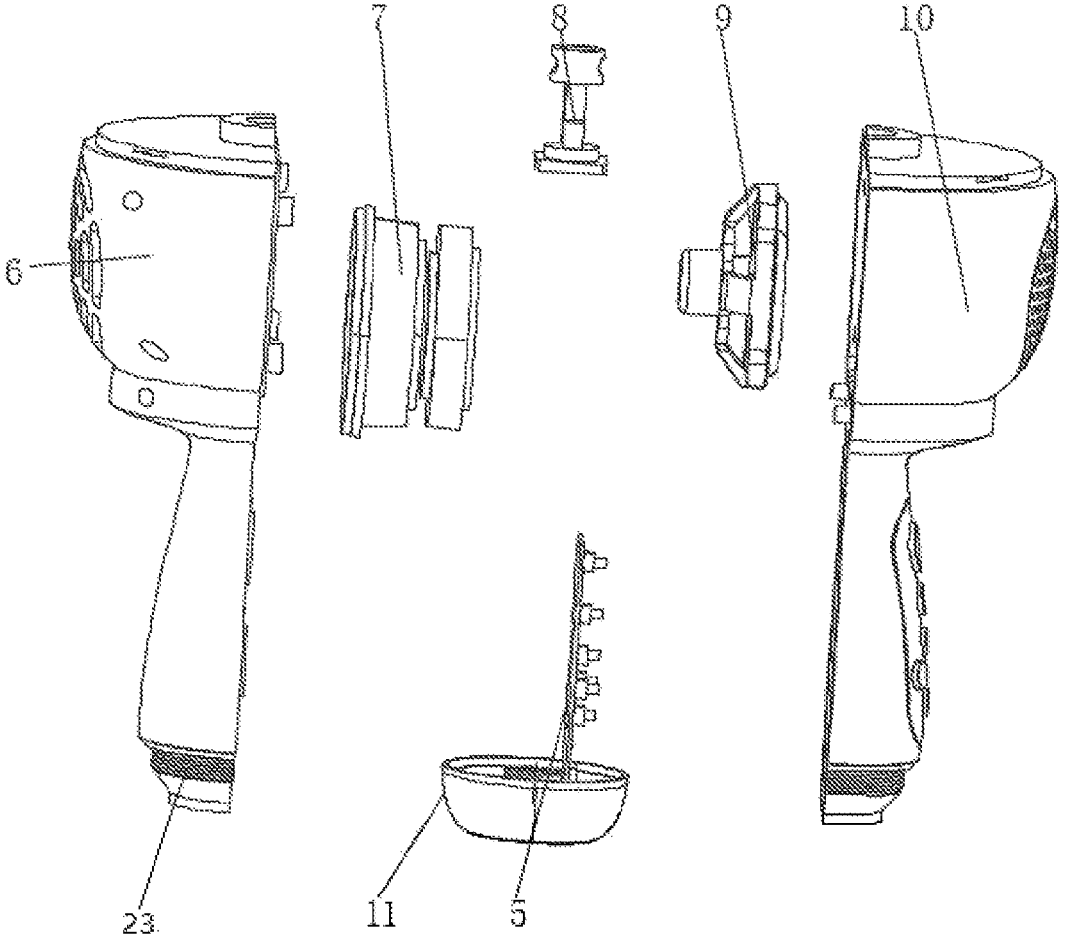
FIG. 3 is an exploded view of a stereo microphone speaker in the disclosure.
Figure 4:
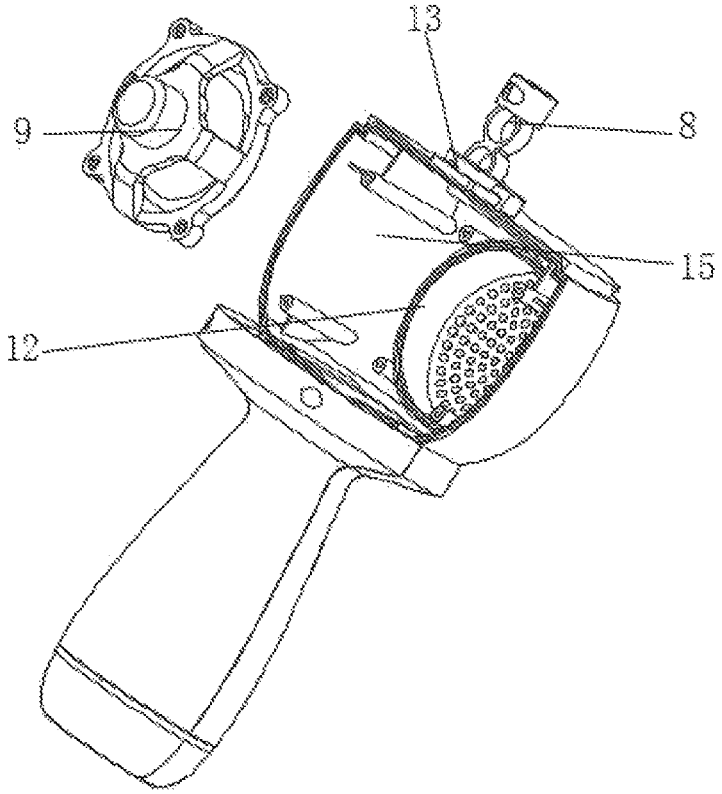
FIG. 4 is a structural schematic diagram of tweeter connections of a stereo microphone speaker in the disclosure.
Figure 5:
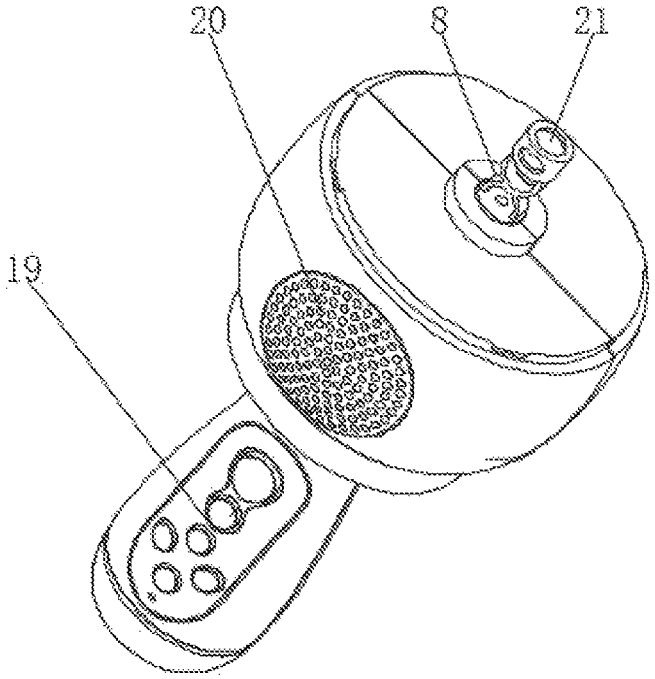
FIG. 5 is a partial external view of a stereo microphone speaker in the disclosure.
Figure 6:
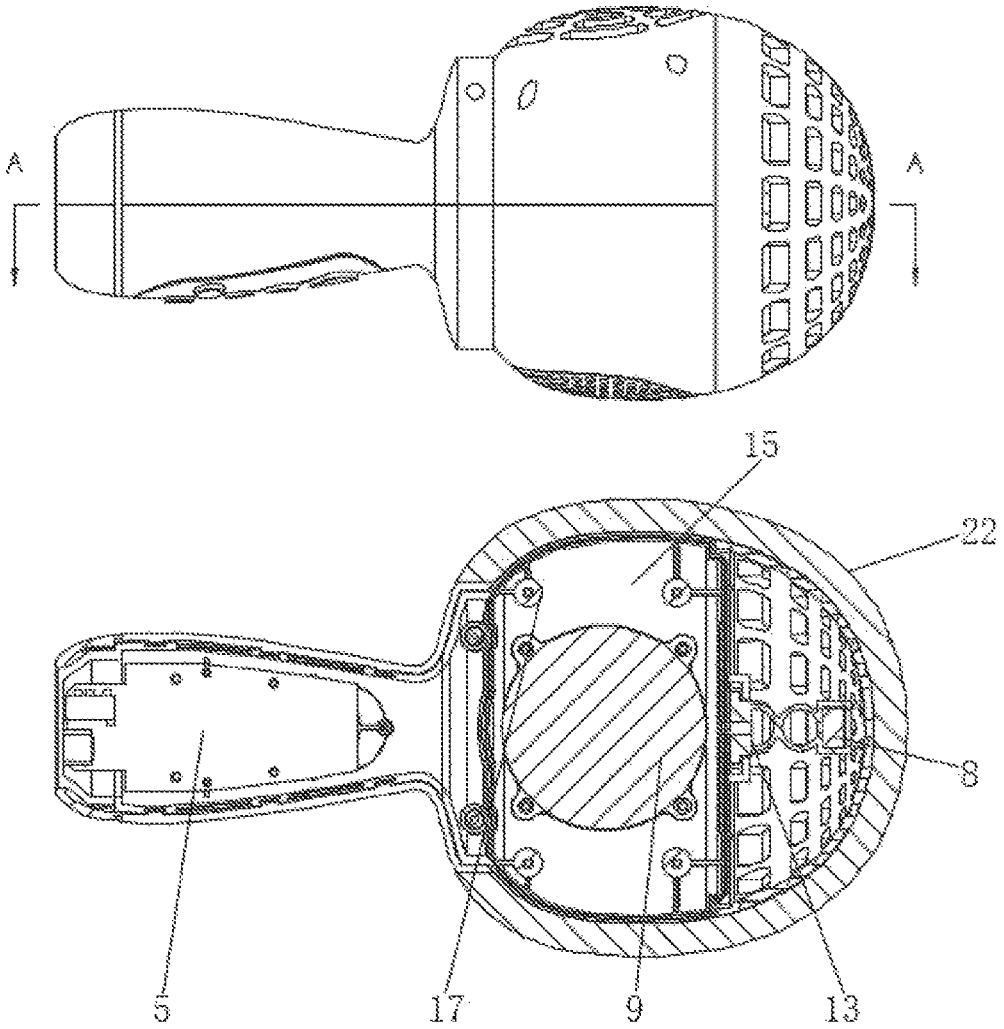
FIG. 6 is a sectional view of handle front covers of a stereo microphone speaker in the disclosure.
Figure 7:
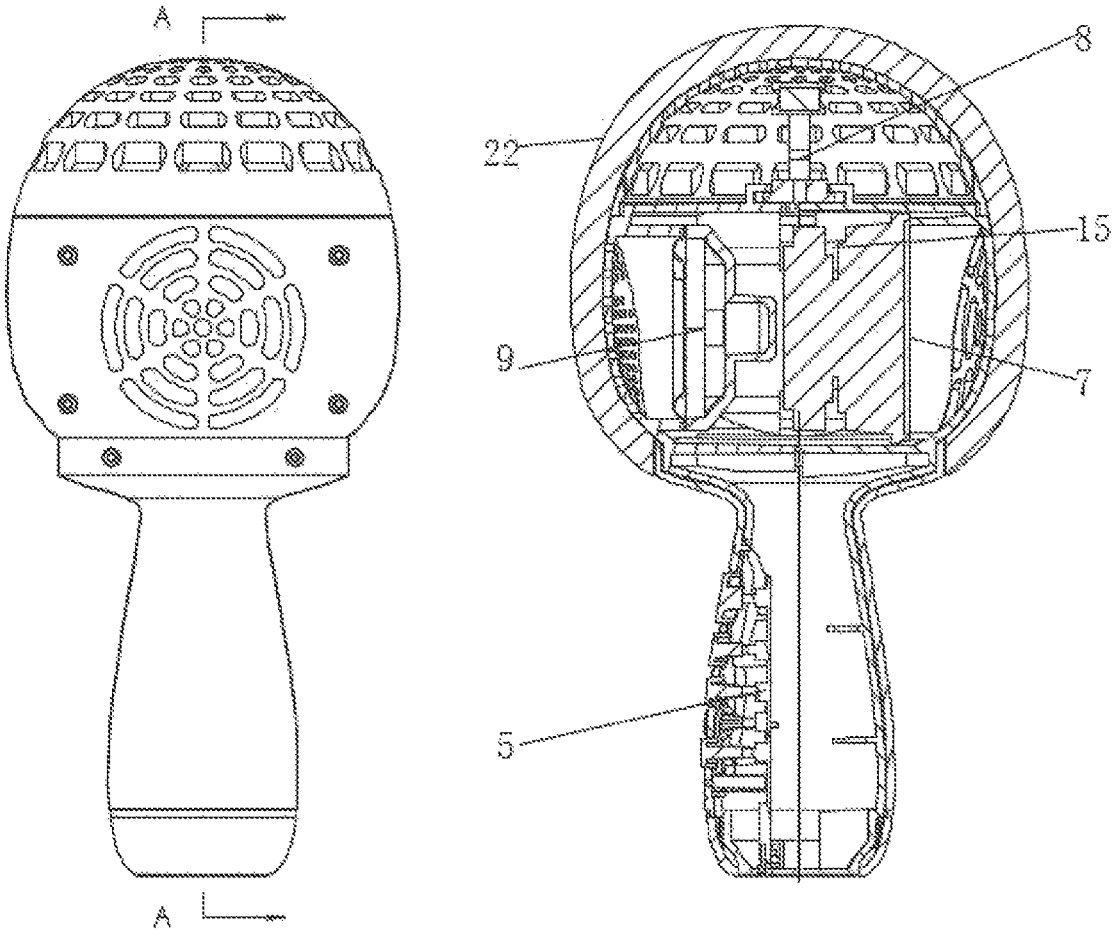
FIG. 7 is an overall sectional side view of a stereo microphone speaker in the disclosure.
Figure 8:
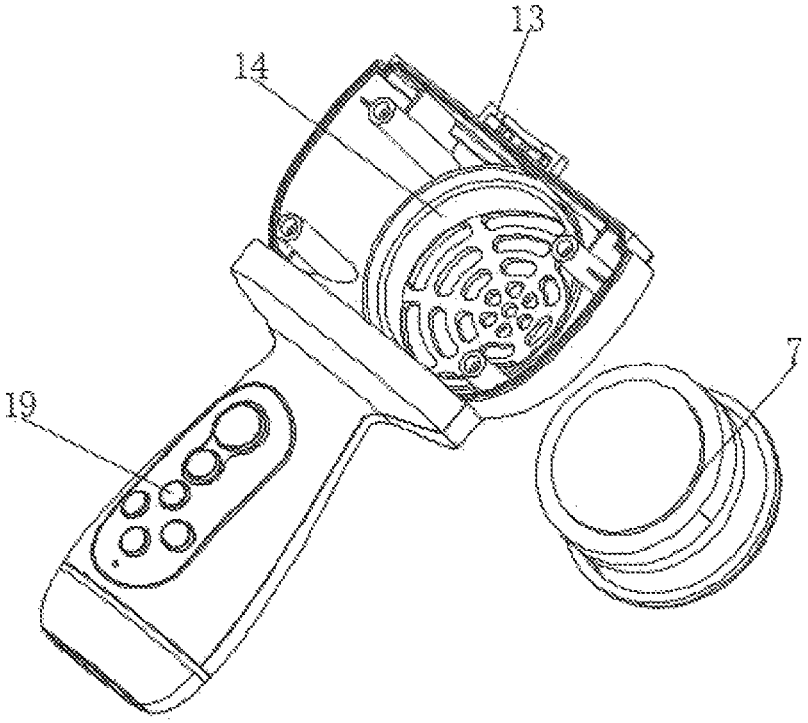
FIG. 8 is a structural schematic diagram of subwoofer connections of a stereo microphone speaker in the disclosure.

As shown in FIGS. 1-8, embodiments of the disclosure disclose the stereo microphone speaker, comprising Printed circuit boards 5, middle housings 17 and handle bodies 16, and end surfaces of the Printed circuit boards 5 are provided with audio frequency dividing modules 3 and audio playback modules 4, to make frequency dividing adjustments on the sound quality, effectively improve the sound quality effect, and enhance the user experience, threads 23 in the lower ends of the handle bodies 16 are connected with bottom covers 11, and the Printed circuit boards 5 relative to interiors of the handle bodies 16 are arranged at the lower ends of interiors of bottom covers 11, sides of lower ends of the Printed circuit boards 5 are provided with audio plugs 1 and one side relative to the audio plug (1) is provided with a charging plug 2, and the audio plugs 1 and charging plugs 2 cut through lower ends of bottom covers 11, easy for audio interfacing and charging use, and by connections between bottom covers 11 and threads 23 in the lower ends of the handle bodies 16, easy for demolition, replacement, maintenance and repair use;

the handle bodies 16 comprise handle rear covers 6 and handle front covers 10, and upper ends of the handle rear covers 6 and handle front covers 10 constitute structures of middle housings 17, sides of the middle housings 17 relative to handle front covers 10 are provided with tweeter holes 20, and interiors of the handle front covers 10 relative to interior sides of tweeter holes 20 are fixedly connected with tweeter mounting cavities 12, interiors of the tweeter mounting cavities 12 are provided with tweeters 9, to improve the sound quality effect, and enhance the user experience:

interior sides of the handle rear covers 6 are provided with subwoofer mounting cavities 14, and interiors of the subwoofer mounting cavities 14 are provided with subwoofers 7, interiors of the middle housings 17 relative to tweeters 9 and subwoofers 7 respectively are provided with voice chambers 15, and upper ends of the middle housings 17 are provided with silicone microphone installation fixing grooves 13, interiors of the silicone microphone installation fixing grooves 13 are provided with silicone microphone supports 8, and interiors of upper ends of the silicone microphone supports 8 are provided with microphone 21, which can effectively lower the howling, improve the sound quality, reduce the harsh sound, so as to enhance the user experience;

upper ends of the middle housings 17 relative to exterior sides of silicone microphone supports 8 are provided with upper housings 18, and outer surfaces of the middle housings 17 and upper housings 18 are provided with microphone head covers 22, to form the exterior protection for middle housings 17 and upper housings 18, avoiding to break when falling to the ground, and then cause damage, and one side of the handle body 16 is provided with function keys 19.

Working Principle: by provided subwoofers 7 and tweeters 9, and audio frequency dividing modules 3 arranged on the Printed circuit boards 5, the sound quality is improved with audio playback modules 4, by setting up silicone microphone supports 8 into silicone microphone installation fixing grooves 13 on the middle housings 17 to form the support use for microphone 21, the howling can be effectively lowered.

Even though embodiments of the disclosure have been displayed and described, for common technicians in the field, it can be understood that without departing from the scope and spirit of the disclosure multiple changes, modifications, replacements and variations can be implemented on these embodiments, and the scope of the disclosure is defined in and by the appended claims and their equivalents.

What is claimed is:

1. A stereo microphone speaker, comprising a Printed circuit board, a middle housing, and a handle body, wherein an audio frequency dividing module and an audio playback module are arranged at end surfaces of the Printed circuit board, and wherein the handle body comprises a handle rear cover and a handle front cover, wherein upper ends of the handle rear cover and handle front cover constitute the middle housing, and a side of the middle housing relative to the handle front cover is provided with a tweeter hole, wherein an interior of the handle front cover relative to an interior of the tweeter hole is fixedly connected with a tweeter mounting cavity, and an interior of the tweeter mounting cavity is provided with a tweeter, wherein an interior side of the handle rear cover is provided with a subwoofer mounting cavity, and an interior of the subwoofer mounting cavity is provided with a subwoofer, an upper end of the middle housing is provided with a silicone microphone installation fixing groove, and an interior of the silicone microphone installation fixing groove is provided with a silicone microphone support, and an interior of an upper end of the silicone microphone support is provided with a microphone.

2. The stereo microphone speaker according to claim 1, wherein a thread in a lower end of the handle body is connected with a bottom cover, and the Printed circuit board relative to interior of the handle body is arranged at the lower end of an interior of the bottom cover.

3. The stereo microphone speaker according to claim 2, wherein a side of a lower end of the Printed circuit board is provided with an audio plug and one side relative to the audio plug is provided with a charging plug, and the audio plug and charging plug cut through the lower end of bottom cover.

4. The stereo microphone speaker according to claim 1, wherein an upper end of the middle housing relative to an exterior side of the silicone microphone support is provided with an upper housing.

5. The stereo microphone speaker according to claim 4, wherein outer surfaces of the middle housing and the upper housing are provided with microphone head covers.

6. The stereo microphone speaker according to claim 1, wherein an interior of the middle housing relative to the tweeter and the subwoofer respectively are provided with voice chambers.

7. The stereo microphone speaker according to claim 1, wherein one side of the handle body is provided with a function key.

* * * * *